US008668328B2

(12) United States Patent
Ray et al.

(10) Patent No.: US 8,668,328 B2
(45) Date of Patent: Mar. 11, 2014

(54) PRINTER INCLUDING POSITIONABLE PRINTING UNITS

(75) Inventors: Paul C. Ray, San Diego, CA (US); Thomas J. Tarnacki, San Diego, CA (US); Mun Yew Lee, San Diego, CA (US); Robert J. Manders, DePere, WI (US); Michael J. Baeten, Green Bay, WI (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 510 days.

(21) Appl. No.: 12/991,118

(22) PCT Filed: May 29, 2008

(86) PCT No.: PCT/US2008/065133

§ 371 (c)(1),
(2), (4) Date: Feb. 1, 2011

(87) PCT Pub. No.: WO2009/145777

PCT Pub. Date: Dec. 3, 2009

(65) Prior Publication Data

US 2011/0149004 A1 Jun. 23, 2011

Related U.S. Application Data

(60) Provisional application No. 60/987,020, filed on Nov. 9, 2007.

(30) Foreign Application Priority Data

May 7, 2008 (DE) ..... 10 2008 022 493

(51) Int. Cl.
*B41J 2/01* (2006.01)

(52) U.S. Cl.
USPC ..... 347/104; 347/101

(58) Field of Classification Search
USPC ..... 347/34, 88, 101, 104; 101/198; 118/118; 400/634
See application file for complete search history.

(56) References Cited

U.S. PATENT DOCUMENTS

| | | | | |
|---|---|---|---|---|
| 4,141,231 | A * | 2/1979 | Kudlich | 68/205 R |
| 5,553,951 | A | 9/1996 | Simpson et al. | |
| 5,793,397 | A * | 8/1998 | Barker et al. | 347/88 |
| 5,820,275 | A | 10/1998 | Crawford et al. | |
| 6,126,750 | A * | 10/2000 | Seiz et al. | 118/118 |
| 6,154,232 | A | 11/2000 | Hickman et al. | |
| 6,172,689 | B1 | 1/2001 | Cunnagin et al. | |
| 6,261,012 | B1 | 7/2001 | Haas et al. | |

(Continued)

FOREIGN PATENT DOCUMENTS

JP 09169126 6/1997

*Primary Examiner* — Manish S Shah
*Assistant Examiner* — Yaovi Ameh

(57) ABSTRACT

A printer includes an array of rollers, an array of printing elements, and a positioning structure. The array of rollers is arranged in a first arc configuration to rollingly support a media web in a first orientation. The array of printing elements is arranged in a second arc configuration along the first orientation and movable relative to the array of rollers to selectively modify a space there between. Each respective printing element is aligned directly above one of the respective rollers to define a printing unit. A positioning structure is configured to releasably secure each printing unit at one position of a plurality of positions along the respective first and second arc configurations.

17 Claims, 6 Drawing Sheets

(56) References Cited

U.S. PATENT DOCUMENTS

| | | | | |
|---|---|---|---|---|
| 6,474,886 | B1 * | 11/2002 | Sugiyama et al. | 400/634 |
| 6,821,039 | B2 | 11/2004 | Lewis | |
| 6,851,787 | B2 | 2/2005 | Johnson | |
| 6,932,455 | B2 | 8/2005 | Monclus et al. | |
| 7,229,149 | B2 | 6/2007 | Wotton et al. | |
| 2003/0116041 | A1 * | 6/2003 | Manes et al. | 101/198 |
| 2004/0080563 | A1 | 4/2004 | Leemhuis | |
| 2004/0212656 | A1 | 10/2004 | Waller et al. | |
| 2006/0209122 | A1 | 9/2006 | Barinaga et al. | |
| 2006/0238561 | A1 | 10/2006 | Carcia et al. | |
| 2011/0181658 | A1 * | 7/2011 | Izawa et al. | 347/34 |

* cited by examiner

PRINTER INCLUDING POSITIONABLE PRINTING UNITS

CROSS-REFERENCE TO RELATED APPLICATIONS

This application is related to U.S. Patent Application Ser. No. 60/987,020, filed Nov. 9, 2007, and entitled PRINT HEAD SERVICE SHUTTLE, which is hereby incorporated by reference.

BACKGROUND

Fluid ejection technology has been applied to a variety of different types of printers, including the web press. In many instances, a conventional web press includes a static arrangement of fluid ejection devices and/or rollers supporting the media web. In addition, performing maintenance operations on the fluid ejection devices of such conventional web presses also frequently includes a time-consuming realignment of the fluid ejection devices.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Embodiments of the present disclosure are directed to a web press including arc-shaped structures that enable the convenient reconfiguration of printing elements and/or rollers while also insuring proper alignment and positioning of the printing elements.

Figure 1:
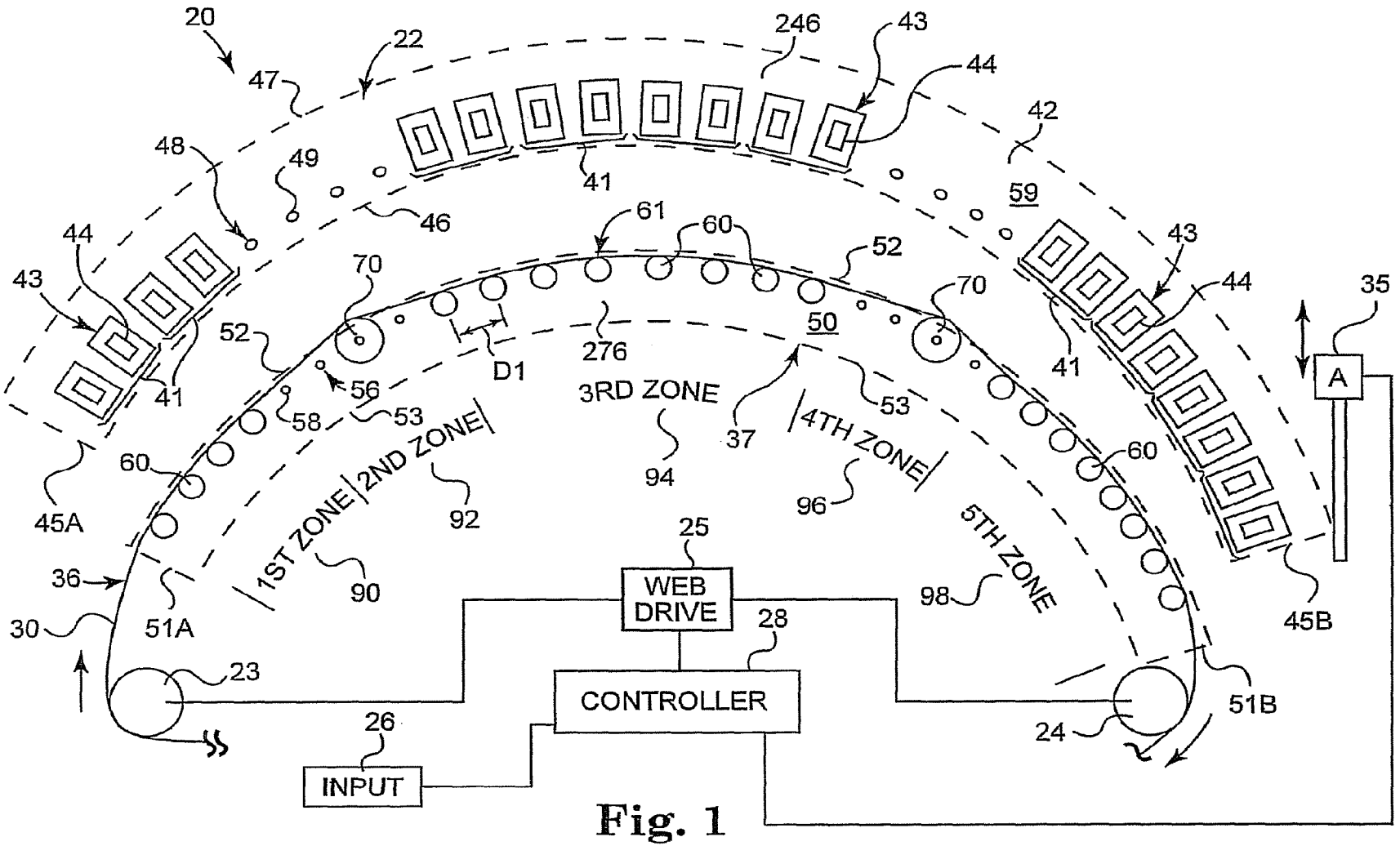
FIG. 1 is schematic illustration of a printing system including a printing module in a raised maintenance position, according to an embodiment of the present disclosure.

FIG. 1 is a schematic illustration of a printing system 20 according to an example embodiment. Printing system 20 is configured to print or otherwise deposit printing material, such as ink or other fluid material, onto a web 30 of media. As will be described hereafter, printing system 20 includes an arch support structure which facilitates proper alignment of printing elements with rollers of a media support, as well as reconfiguration of the printing elements among different positions along the arch support structure.

Printing system 20 includes a print module 22 and media support 37. Print module 22 selectively deposits printing material upon web 30 to form an image, pattern, layout or arrangement of printing material upon web 30. In one embodiment, web 30 may comprise a web of printing material such as a cellulose-based media. In another embodiment, web 30 may comprise a web of polymeric material. In yet another embodiment, web 30 may comprise one or more other materials. In one embodiment, the printing material comprises a fluid such as one or more inks. In yet other embodiments, the printing material may comprise other types of fluid.

Media support 37 of printing system 20 receives the web 30 of media from a web supply 23, and after printing module 22 prints upon web 30, media support 37 discharges the printed upon web 30 to media rewind 24 which rewinds the web 30 of media. Each of web supply 23 and media rewind 24 comprises one or more rollers which are controlled by web drive 25 and therefore each of web supply 23 and media rewind 24 act as control rollers. Although web 30 is illustrated as continuously extending from supply 23, across print module 22 and media support 37, to rewind 24, in other embodiments, media rewind 24 may be omitted where the printed upon web 30 of media is severed or processed in other fashions.

Figure 2:
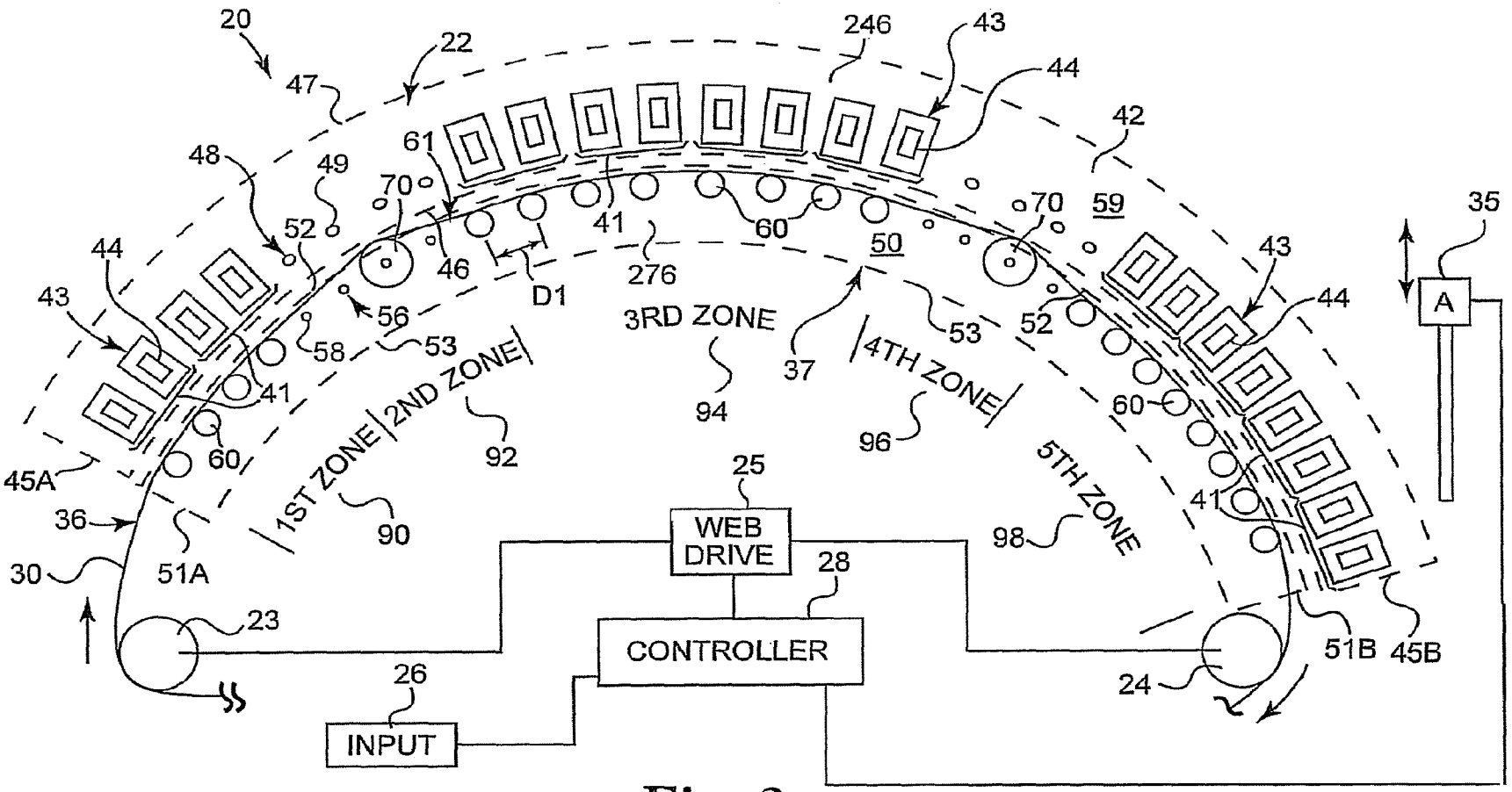
FIG. 2 is schematic illustration of the printing system of FIG. 1 with the printing module in a lowered printing position, according to an embodiment of the present disclosure.

In one embodiment, print module 22 includes main support 42, printhead supports 41, and one or more pens or cartridges 43 that each include printheads 44. As shown in FIGS. 1-2, main support 42 comprises an arc shaped frame and is represented in dashed lines for illustrative purposes to better represent the arc configuration of cartridges 43 and printhead supports 41 (as supported by main support 42) which would otherwise be obscured by main support 42 in FIGS. 1-2. In one embodiment, main support 42 includes a bottom portion 46, a top portion 47, a first end 45A, and a second end 45B.

Main support 42 of printing module 22 comprises an arcuate frame 59 or structure configured to support individual print supports 41 (and their cartridges 43) in an arch configuration opposite to web 30. Moreover, printhead supports 41 (sometimes referred to as print bars) extend across a width of media support 37 to support the one or more print cartridges 43. Supports 41 facilitate removal of cartridges 43 from main support 42 for repair or replacement of individual print cartridges 43 without removal of all of the print cartridges 43 from main support 42. Supports 41 are later described in more detail in association with FIG. 5.

In one embodiment, actuator 35 is configured to move main support 42 towards and away from web 30. In yet another embodiment, printing system 20 omits the actuator 35 so that main support 42 is stationary opposite to web 30. When present, actuator 35 comprises a mechanism configured to selectively raise and lower main support 42 to raise and lower printhead supports 41 (and their cartridges 43) relative, to web flow path 36 and web 30. In one aspect, because each printhead support 41 is releasably secured relative to main support 42, movement of main support 42 results in moving the printhead supports 41 (and their cartridges 43) in unison. Accordingly, via actuator 35, main support 42 may be moved to facilitate enhanced access to cartridges 43 for inspection, servicing, repair, or replacement.

In one embodiment, actuator 35 comprises one or more hydraulic or pneumatic cylinder assemblies. In another embodiment, actuator 35 comprises one or more electric solenoids. In yet another embodiment, actuator 35 may comprise one or more cams driven by one or more motors. In other embodiments, ball screw mechanisms are used. In such embodiments, movement of support 42 by actuator 35 may be guided by one or more guide rods, tracks or other guide structures. In still other embodiments, the one or more guides may be omitted.

FIGS. 1 and 2 illustrate the different positions of print module 22 of printing system 20 relative to media support 37. FIG. 1 illustrates printing system 20 in a service or maintenance mode while FIG. 2 illustrates a printing system 20 in a printing mode. As shown in FIG. 2, controller 28 generates control signals directing actuator 35 to lower main support 42 which lowers individual print head supports 41 (and their associated cartridges 43) from a maintenance position (shown in FIG. 1) to a lowered printing position shown in FIG. 2 in which print heads 44 are closely spaced to web 30 supported by media support 37. In one aspect, in the lowered printing position (FIG. 2) each print head 44 of printing module 22 is spaced from web 30 by a gap G as further illustrated in FIG. 3. For example, in one embodiment, in the printing mode a gap G between printheads 44 of cartridges 43 and web 30 is less than or equal to about 1 mm. In other embodiments, this gap may have other dimensions.

In the embodiment shown in FIGS. 1-2, media support 37 is in a fixed position while main support 42 moves towards media support 37 for positioning in the printing mode and main support 42 moves away from media support 37 for positioning in the service mode. However, in another embodiment, main support 42 is in a fixed position while media support 37 moves towards main support 42 for positioning in the printing mode and media support 37 moves away from main support 42 for positioning in the service mode.

For illustrative purposes, FIG. 2 shows a larger-than-normal gap between main support 42 and media support 37, and therefore a larger-than-normal gap between print cartridges 43 and web 30 so that the general relationship between the various elements of print module 22 and the various elements of media support 37 can be viewed. Accordingly, in the printing mode, the print module 22 is ordinarily much closer to the web 30 and media support 37 (than shown in FIG. 2).

After movement of the print module 22 into the printing position is completed, controller 28 generates additional control signals directing cartridges 43 and print heads 44 to deposit a printing material upon web 30.

Referring again to FIGS. 1-2, cartridges 43 (also known as pens) comprise mechanisms configured to eject fluid onto web 30. In the particular example illustrated, cartridges 43 each include one or more print heads 44 (schematically shown as part of cartridges 43). In one embodiment, print heads 44 each comprise thermal resistive drop-on-demand inkjet print heads. In yet other embodiments, print heads 44 may comprise piezo-resistive inkjet print heads. In still other embodiments, print heads 44 may comprise other mechanisms configured to eject fluid in a controlled manner.

According to one embodiment, cartridges 43 each include a self-contained reservoir of fluid which is applied to the associated print heads 44. In yet another embodiment, cartridges 43 each include a reservoir which is further supplied with fluid or ink via an off-axis ink supply system using one or more pumps or other mechanisms to supply a fluid to each of cartridges 43. In one embodiment, cartridges 43 of print module 22 are configured to apply multiple colors of ink. In the embodiment illustrated, cartridges 43 configured to deposit black (K), cyan (C), magenta (M) and yellow (Y) colored inks. In the example illustrated, print module 22 is additionally configured to apply a fixer (F) to web 30 prior to application of the colored inks. In other embodiments, print module 22 may include a fewer or greater of such cartridges 43 configured to apply a fewer or greater of such different types of fluid.

Media support 37 comprises one or more structures configured to support and guide movement of web 30 in a path across an opposite to print heads 44 of cartridges 43. In the particular embodiment illustrated, media support 37 supports web 30 in an arc opposite to print heads 44. This arc configuration, in turn, permits the frame 50 of print module 22 to be formed in a more compact configuration, thereby enhancing control over the spacing between print heads 44 and media web 30. In one embodiment, the arc-shaped configuration of media support 37 comprises an arcuate frame 50 supporting a series 61 of rollers 60 in an arcuate pattern. In one embodiment, arcuate frame 50 of media support 37 comprises a top portion 52, bottom portion 53, and side portions 51A, 51B.

In one aspect, the arcuate pattern of rollers 60 is shaped and sized so that when main support 42 is lowered into its print position, the arc configuration of the cartridges 43 (as supported by frame 59 of main support 42) substantially matches the arcuate pattern of rollers 60 so that a substantially uniform gap is provided between the printheads 44 (of cartridges 43) and media web 30 along the length of media web 30 extending underneath cartridges 43 of print module 22.

In another embodiment, media support 37 may comprise an arcuate plate or platen. In other embodiments, media support 37 may have other configurations.

Web flow path 36 comprises a path formed by one or more stationary or movable structures along which web 30 is guided and moved. In the particular example illustrated, web flow path 36 is formed by the arcuately arranged rollers 60 forming media support 37, and as well as other control rollers that act in support of media rewind 24 and 23.

Figure 3:
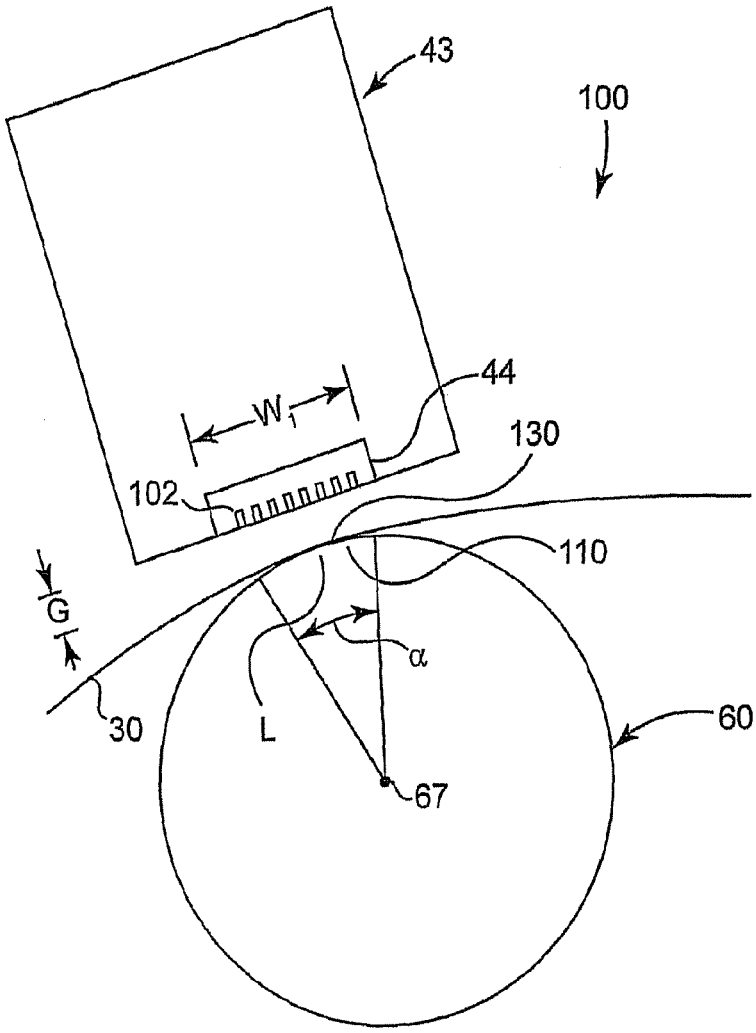
FIG. 3 is schematic illustration of a printing element and a roller of a printing system, according to an embodiment of the present disclosure.

In one aspect, each roller 60 comprises a rotationally supported cylinder or rollers which rotates about it individual axis 67, as shown in FIG. 3. Rollers 60 facilitate maintaining tension on media web 30 while permitting relatively smooth movement of web 30 with minimal friction upon web 30. In other embodiment, rollers 60 of media support 37 may include a greater or fewer of such rollers or may include other structures configured to support web 30 in an arc opposite to main support 42. For example, in another embodiment, rollers 60 may be replaced with one or more arcuate platens or plates.

Media supply 23 and media rewind 24 comprise independently rotationally driven rollers which further define or form web flow path 36 and which move media web 30 along web flow path 36. Media supply 23 is located immediately upstream of cartridges 43 and their associated print heads 44. Media rewind 24 is located immediately downstream of cartridges 43 and their associated print heads 44 along web flow path 36. A general printing zone is defined between media supply 23 and media rewind 24 as web 30 extends across rollers 60. The rollers comprising media supply 23 and media rewind 24 are configured to be driven at different speeds, facilitating adjustment of the tension of web 30 across and opposite to cartridges 43 during printing upon web 30. At the same time, media supply 23 and media rewind 24 may be driven at substantially the same speed, facilitating precise velocity control of web 30 across the printing zone formed by media supply 23, media rewind 24, and rollers 60. In one aspect, web drive 25 comprises one or more mechanisms configured to rotationally drive rollers 23, 24, which in turn, selectively supplies distinct levels of torque or velocity to rollers 23, 24 using one or more transmissions and clutch mechanisms.

Input 26 comprises one or more mechanisms by which instructions or commands may be provided to controller 28. Examples of input 26, include, but are not limited to, a keyboard, a keypad, a touchpad, a touch screen, a microphone with speech recognition software, one or more buttons, switches and the like. Although input 26 is illustrated as being associated with print module 22, input 26 may alternatively be associated with a dryer module or may be an external source of commands which transmits control signals via the internet, a network or other wired or wireless communication medium.

Controller 28 comprises one or more processing units and associated memories configured to generate control signals directing the operation of print module 22. In particular, in response to or based upon commands received via input 26 or instructions contained in the memory of controller 28, controller 28 generates control signals directing operation of actuator 35 to selectively raise and lower support 42 and cartridges 43, control signals directing the application or deposition of printing material by cartridges 43 and print heads 44, and control signals directing supply 23 and/or rewind 24 to control the tension of web 30 and directing the rate at which web 30 is moved across media support 37.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 28 may be embodied as part of one or more application-specific integrated circuits (ASICs). Unless otherwise specifically noted, the controller is not limited to any specific combination of hardware circuitry and software, nor limited to any particular source for the instructions executed by the processing unit.

With this general configuration in mind, further details regarding the print module 22 and media support 37 will be described hereafter. In one embodiment, printing system 20 comprises an array of printing units 100 with each printing unit 100 defined by at least one cartridge 43 (or a row of cartridges 43) of print module 22 and one of the respective rollers 60 of media support 37. In one aspect, as illustrated in FIG. 3, each row of print cartridges 43 (as supported by main support 42 of printing module 22) is aligned directly over a matching roller 60 (as supported by media support 37). This arrangement insures that the portion of media 30 being printed on (via a row of print cartridges 43) is directly supported by a roller 60 to insure that media 30 receives adequate support and is under proper tension as it receives the ejected ink. This alignment is further described in association with FIG. 3.

FIG. 3 schematically illustrates one individual printing unit 100, according to one embodiment of the present disclosure. As shown in FIG. 3, the printing unit 100 includes one cartridge 43 (representing a row of cartridges aligned axially with the illustrated cartridge) and one roller 40 with printhead 44 aligned directly above a contact region 110 of roller 60 facing printhead 44. In another aspect, as shown in FIGS. 1-2, an arcuate frame 50 forming media support 37 defines a radius (R1) and the respective rollers 60 are spaced apart from each other by a minimum distance (D1) such that the media web 30 is in rolling contact with an arc length (L) of the roller 60 (shown in FIG. 3) instead of just a conventional single point of contact. In one aspect, the arc length L of rolling contact corresponds to an angle ($\alpha$) of about 4-5 degrees of a 360 degree circumference of the roller 60 and defines the contact region 110 of roller 60. However, it is understood that the contact region 100 does not define a static portion of roller 60 but rather defines a portion of the rotating roller 60 that contacts media web 30 (as the respective roller 60 rotates to rollingly support media web 30).

With this arrangement, the large amount of rolling contact accentuates the local tension of the media web 30 in the vicinity of the printhead cartridge 43, thereby increasing the quality of printing. In addition, this large amount of rolling contact (between media web 30 and roller 60) also increases the amount of media web 30 that can be printed on by a single row of cartridges 43. In particular, instead of printing from just one or two rows 102 of nozzles from a single row of printheads 44, this arrangement enables printing from a substantially greater number of rows 102 of nozzles of a printhead 44, such as eight rows of nozzles (extending in the direction of media travel) on a single row of printheads. In other words, by substantially increasing the area of media web 30 in contact with the roller (about 4-5 degrees instead of the conventional 1-2 degrees of contact), the area of media web available for printing (while being directly supported by the roller 6) is substantially increased, which in turn, enables using a substantially greater active printing area (e.g., using 8 rows 102 of nozzles instead of using just 1-2 rows 102 of nozzles) of the printhead 44.

Figure 5:
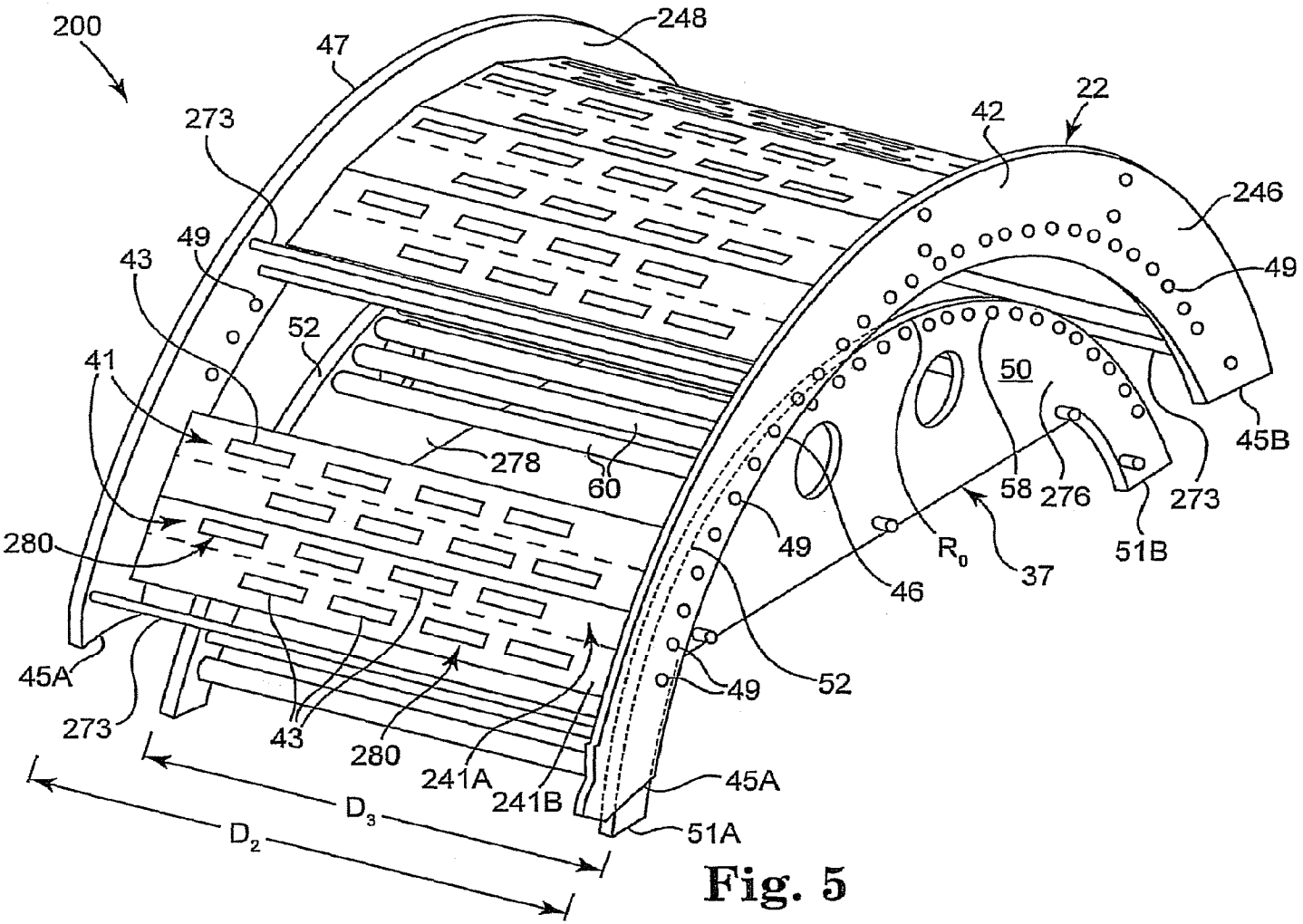
FIG. 5 is perspective view of a printing system including a first arcuate frame supporting an array of printing elements and a second arcuate frame supporting an array of rollers, according to an embodiment of the present disclosure.

Referring again to FIGS. 1 and 2, in another aspect, the particular shape and arrangement of main support 42 and media support 37 cooperate to enable repositioning and interchangeability of one or more of the individual printing units 100. As previously identified, in one embodiment, media support 37 comprises a first arcuate frame 50 and a second arcuate frame 59 forms main support 42 of print module 22. While the first arcuate frame 50 comprises a pair of spaced apart arcuate plates 276, 278 (as shown more fully in FIG. 5) with rollers 60 extending and supported therebetween, just one plate 276 is illustrated in FIGS. 1-2. Likewise, while the second arcuate frame 59 comprises a pair of spaced apart arcuate plates 246, 248 (as shown in FIG. 5) with the printhead supports 41 (and associated cartridges 43) extending and supported therebetween, just one of the respective plates 246 is illustrated in FIGS. 1-2.

Referring again to FIGS. 1-2, in one embodiment, first arcuate frame 50 of media support 37 also includes an arc-shaped array 56 of holes 58 extending along the arc-shaped top portion 52. In one aspect, each hole 58 is configured to releasably secure each roller 60 in position along the arc and thereby enables selective positioning of the respective rollers 60 along the arc-shaped top portion 52 of media support 37. Accordingly, rollers 60 are individually removable and insertable at different positions along their arc configuration to form one or more separate series of rollers 60 along media support 37 that are commensurate with a complimentary pattern of print cartridges 43 (supported by main support 42 of print module 22) above the respective rollers 60.

Although rollers 60 are depicted in FIGS. 1-2 as being below top portion 52 (i.e., not extending above top portion 52) for illustrative clarity to identify the rollers 60 separately from web 30 and separately from top portion 52, it is understood that the rollers 60 are normally positioned at or near an edge of top portion 52 of media support 37 so that a top portion of the rotatable rollers 60 are in close proximity to a printhead 44 (or row of printheads 44) of print module 22.

As understood by those skilled in the art, a variety of different fasteners may be employed to secure the roller 60 relative to the hole 58. In the simplest form, the roller 60 includes a rod (not shown) aligned with its central axis 67 and which is slidably insertable into hole 58. In one embodiment, holes 58 are spaced apart uniformly while in other embodiments, holes 58 are spaced apart non-uniformly.

In another aspect, second arcuate frame 59 comprises an arc-shaped array 48 of holes 49 extending along arc-shaped bottom portion 46 of frame 59 of print module 22. Holes 49 are configured to releasably secure printhead supports 41 in selected positions along the arc-shaped bottom portion 46 to form a pattern of printhead supports 41 (and their cartridges 43) that substantially match a pattern of rollers 60 mounted in first arcuate frame 50 of media support, as previously described. In one embodiment, holes 49 are spaced apart uniformly while in other embodiments, holes 49 are spaced apart non-uniformly.

In one embodiment, as shown in FIGS. 1-2 and 5, each printhead support 41 supports two rows 280 of cartridges 43. In this embodiment, each printhead support 41 is supported by a pair of adjacent holes 49 in each one of the respective spaced apart plates 246. 248 of second arcuate frame 59, as further illustrated in FIG. 5. However, in other embodiments, each printhead support 41 supports just one row of cartridges 43 and each printhead support 41 is supported by a single hole 49 in each one of the respective spaced apart plates 246, 248 of second arcuate frame 22, as later described in more detail in association with FIG. 5.

In other embodiments, a row of print cartridges 43 are configured to extend between, and be directly supported by, the respective spaced apart plates 246,248 of the main support 42, thereby omitting printhead supports 41. In this instance, each row of print cartridges 43 is releasably secured within one of the respective holes 49 of each of the respective spaced apart plates 246, 248 of main support 42, thereby facilitating repositioning of the row of print cartridges 43.

Because first and second arcuate frames 50 and 59 (of media support 37 and print module 22, respectively) enable quick and convenient repositioning, grouping, insertion, and removal of printhead supports 41 (and their cartridges 43) and rollers 60, web flow path 36 of printer system 20 can be divided into separate zones. Each separate zone is defined by the inclusion or omission of one or more printing units 100 with each unit 100 including a row of print cartridges 43 and a matching roller 60. In one non-limiting example illustrated in FIGS. 1-2 and 5, printer system 20 includes $1^{st}$ zone 90, $2^{nd}$ zone 92, $3^{rd}$ zone 94, $4^{th}$ zone 96, and $5^{th}$ zone 98. In one aspect, $1^{st}$ zone 90 comprises a pretreatment zone in which media 30 is pretreated with a fixer or other material to facilitate high quality printing in later printing zones. In another aspect, $2^{nd}$ zone 92 comprises rest zone while $3^{rd}$ zone 94 comprises a printing zone. The rest function of the $2^{nd}$ zone 92 provides time for the pretreatment to further act on media web 30 prior to printing in the $3^{rd}$ zone 94.

In one embodiment, the rest zone in the $2^{nd}$ zone 92 is defined by the omission of several individual printing units 100 so that no printing action or pretreatment action is taken on media 30. Accordingly, printhead supports 41 in this $2^{nd}$ zone are removed from their removably secured position within holes 49 of main support 42. Upon removing the complementary roller 60 (each roller 60 corresponding to a row of cartridges) from media support 37, the individual printing units 100 are omitted in the $2^{nd}$ zone 92. In one aspect, the removal of rollers 60 to define the rest zone (i.e., $2^{nd}$ zone 92) also reduces the overall friction on media web 30 along web path 36.

However, in some embodiments, in zones that omit rollers 60, a spacer roller 70 is inserted (as shown in FIGS. 1-2) within the zone to maintain tension on the media web 30 between the preceding treatment zone and successive printing zone. In one embodiment, spacer roller 70 has a diameter greater than a diameter of the respective rollers 60 so that a single spacer roller 70 acts to maintain proper tension on media web 30 and also causes media web 30 to generally track the shape of the top portion 52 of the arcuate frame 50 of media support 37. As shown in FIGS. 1-2, the spacer roller 70 is positioned among several empty holes 58 of arcuate frame 50 of media support 37 (where rollers 60 have been omitted). In another aspect, the spacer roller 70 acts to maintain proper spacing of media web 30 from other elements (e.g., structural cross supports) of media support 37.

In one aspect, $3^{rd}$ zone 94 comprises a main printing zone configured to dispense ink onto media 30 while $4^{th}$ zone 96 comprises a second rest zone. As shown in FIGS. 1-2, $3^{rd}$ zone 94 comprises a series of printhead supports 41 to support several rows of print cartridges 43. In another aspect, the $3^{rd}$ zone 94 comprises a series of printing units 100 with each printing unit 100 being defined by a row of cartridges 43 being aligned directly over a single roller 60 of media support 37. In one non-limiting example, each printhead support 41 supports two rows of cartridges of a particular color, such as one of cyan, magenta, yellow or black with the other printhead supports 41 supporting one of the other colors so that the printing zone 96 includes a complete complement of colors.

The $4^{th}$ zone 96 comprises a rest zone in a manner substantially the same as $2^{nd}$ zone 92 (i.e., rest zone 92) to permit sufficient drying time of the ink from $3^{rd}$ zone 94 onto media web 30 before another sequence of printing occurs in $5^{th}$ zone 98.

In another aspect, $5^{th}$ zone 98 comprises a printing zone for printing additional ink onto media 30 and may comprise substantially the same features and attributes as $3^{rd}$ zone 94. In other embodiments, $5^{th}$ zone 98 comprises a different number of rows of print cartridges 43 and/or a different set of colored inks for deposit onto media web 30.

However, it is understood that printing system 20 is not limited to the particular sizes and arrangements of printing zones 90-98 as each printing zone can have a greater or lesser number of cartridges 43 (with a corresponding greater or lesser number of rollers 60). Likewise, other embodiments of printing system 20 can have a greater or lesser number of rest zones (which omit cartridges 43 and their associated rollers 60). Moreover, other embodiments of printing system 20 include a greater or lesser number of print zones.

Figure 4:
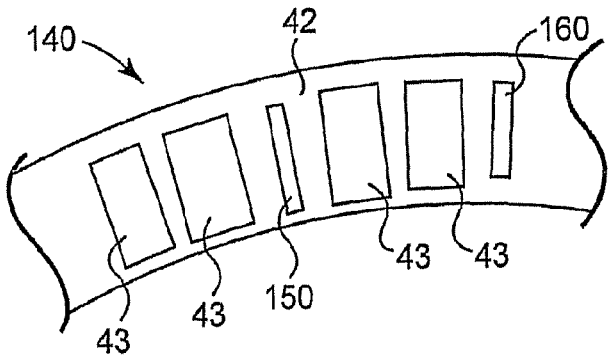
FIG. 4 is schematic illustration of an array of printing elements and non-printing elements along an arc configuration, according to an embodiment of the present disclosure.

FIG. 4 is a partial view of a printing module 140, according to one embodiment of the present disclosure. In one aspect, printing module 140 includes substantially the same features and attributes as printing module 22 as previously described and illustrated in FIGS. 1-3. In addition, printing module 140 includes an array of printhead cartridges 43 in an arc configuration with non-printing elements 150 and/or 160 interposed between adjacent printhead cartridges 43. In one example, a non-printing element 150 includes an aerosol duct for vacuuming aerosol particles away from the media web 30 during printing.

In one embodiment, non-printing elements 150 or 160 are supported by the second arcuate frame 59 forming main support 42 of printing module 140 via holes 49 to permit reconfiguring the position of the non-printing elements 150 or 160 relative to each other and/or relative to print cartridges 43. In other embodiments, non-printing elements 150 or 160 are supported via one of the print supports 41 (FIGS. 1, 2, and 5) and therefore are indirectly supported by frame 59 of main support 42. Accordingly, in addition to permitting selective reconfiguration of printing elements, such as print cartridges 43, printing system 20 enables interposing, interchanging, and reconfiguring non-printing elements 150, 160 along with printing elements, such as print cartridges 43.

FIG. 5 is a perspective view of a printing system 200, according to one embodiment of the present disclosure. In one aspect, printing system 200 includes substantially the same features and attributes as printing system 20 as previously described and illustrated in FIGS. 1-3 with like reference numerals referring to like elements. In one embodiment, as shown in FIG. 5, printing system 200 comprises a printing module 22 and a media support 37. The printing module 22 includes main support 42 that supports an array of printhead supports 41, which are represented schematically. Each printhead support 41 extends between two spaced apart, arch-shaped plates 246, 248 and supports one or more rows 280 of cartridges 43. Together, the printhead supports 41 extend in an arc configuration along the web flow path 36 as established by the arc-shaped plates 246, 248 of main support 42.

In one embodiment, each printhead support 41 supports two rows 280 of cartridges 43 and each printhead support 41 is supported via two holes 49 of array within plates 246, 248 of main support 42. As understood by one skilled in the art, a variety of fasteners cooperable with holes 49 are used to secure the printhead supports 41 relative to plates 246, 248. Accordingly, in this arrangement, with the positioning of a single printhead support 41 along the arc of plates 246, 248, the rows 280 of cartridges 43 are positioned in an arc configuration a pair at a time.

However, in another embodiment as previously identified in association with FIGS. 1-2, each printhead support 41 is divided into two separate portions (schematically represented by elements 241A and 241B) with each separate portion 241A, 241B supporting a single row of cartridges 43. In this arrangement, each printhead support 241A, 241B is supported via a single hole 49 on each plate 246, 248 of main support 42. Accordingly, in this arrangement, each row of cartridges 43 is positioned or re-positioned one at a time instead of a pair at a time (as in the former embodiment).

In one embodiment, print module 22 also comprises cross supports 273 that extend between, and are supported by, plates 246, 248. However, at the same time, cross supports 273 maintain proper spacing between the respective plates 246, 248 and provide stability to the arcuate frame 59 forming main support 42. This stability is of particular interest when the printhead supports 41 (with rows of cartridges 43 thereon) are sometimes removed, interchanged, or omitted in some locations along the arcuate frame 59 of main support 42. In these instances, the cross supports 273 maintain the plates 246, 248 in their fixed, spaced apart positions relative to each other. While not shown in FIG. 5 for illustrative clarity, additional cross supports 273 also extend between and support plates 276, 278 of arcuate frame 50 of media support 37 in a manner substantially similar to the support to main support 42.

Figure 7:
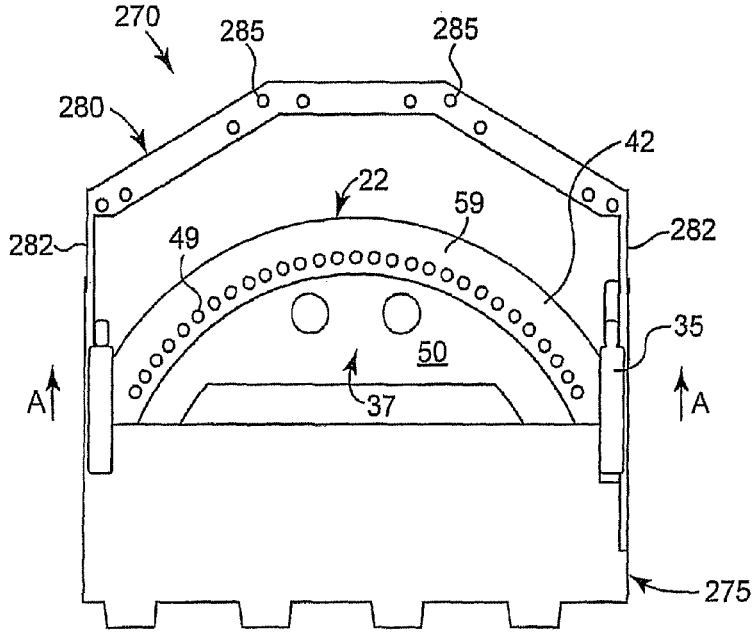
FIG. 7 is a front view of a printing system including the printing module in a second lowered position, according to an embodiment of the present disclosure.

In another aspect, FIG. 5 illustrates that a distance (D2) of separation between plates 246, 248 of arcuate frame 59 forming main support 42 is greater than a distance (D3) of separation between plates 276, 278 of arcuate frame 50 forming media support 37. In other words, the frame 50 of media support 37 is narrower than frame 59 of print module 22 (along an orientation perpendicular to the web flow path 36) so that the media support 37 effectively nests within the main support 42 of the printing module 22 when the printing module 22 is moved to a lowered printing position, as shown in FIG. 2 and FIG. 7. This nesting arrangement causes the printheads 44 of print cartridges 243 to be positioned in close proximity (see, for example, FIG. 3) relative to media web 30 and rollers 60 of media support 37. Moreover, as illustrated by FIG. 3 and FIGS. 1-2, this nesting arrangement further facilitates direct alignment between a row of cartridges 43 and just one of the respective rollers 60 to form the individual printing units 100.

Figure 6:
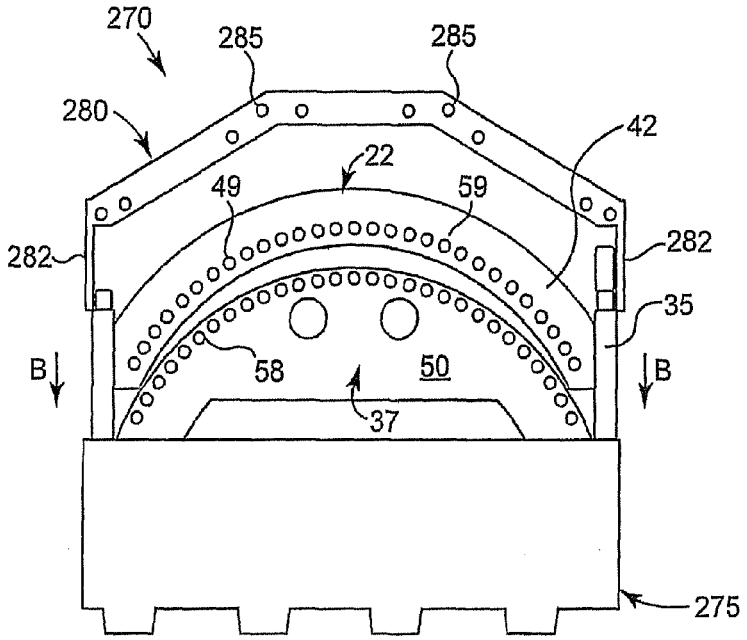
FIG. 6 is a front view of a printing system including a printing module in a first raised position, according to an embodiment of the present disclosure.

FIG. 6 illustrates printing system 270 in a printhead servicing mode and FIG. 7 illustrates printing system 270 in a printing mode. In one embodiment, printing system 270 comprises substantially the same features and attributes of printing system 20 and 200 as previously described in association with FIGS. 1-5. As shown in FIGS. 6-7, printing system 270 comprises a base 275 supporting first arcuate frame 50 of media support 37, actuator 35, and second arcuate frame 59 of print module 22. In addition, in some embodiments, printing system 270 additionally comprises an overhead frame 280 extending upward from a pair of vertical supports 282 associated with actuator 35. In one aspect, overhead frame 280 provides a series of rollers 285 arranged to provide an additional portion of web flow path 36 for guiding web media 30 to and from the control rollers forming media supply 23 and media rewind 24 (shown in FIGS. 1-2). In addition, in another aspect, when included in printing system 270 overhead frame 280 also may provide additional structural support for the arcuate frames 50 and 59 of printing system 20.

With this configuration in mind, printing system 270 enables movement of print module 22 between a service position and a printing position. Accordingly, in response to commands received via input 26 (shown in FIG. 1) or based upon stored instructions or stored parameters, controller 28 (shown in FIG. 1) generates control signals to initiate servicing. In one embodiment, controller 28 may have a set of instructions stored in memory that automatically initiate the servicing mode upon the lapse of a predetermined amount of time, at predetermined times, or based upon usage of a printing and/or drying system, such as the amount of printing material used or the amount of web 30 (FIGS. 1-2) that is printed upon, exceeding an input or stored threshold.

As illustrated by FIGS. 6-7, controller 28 initiates servicing by generating control signals directing actuator 35 to lift or raise print module 22 from the lowered printing position as shown in FIG. 7 (in the direction indicated by arrow A) to the raised service position shown in FIG. 6. In the raised position, print module 22 is spaced from media support 37 by a distance sufficient to allow positioning of a service mechanism between the printheads and the media support 37. In one embodiment, actuator 35 raises frame 59 of print module 22 which causes all of the associated printhead supports 41 and their associated cartridges 43 (shown in FIGS. 1-2) to be moved to the raised position in unison.

Once print module 22 has been moved to the raised position shown in FIG. 6, controller 28 generates control signals directing a servicing mechanism (not shown) to a position in the open space between the raised print module 22 and the web 30. Once positioned across from print heads 44, the servicing mechanism performs the one or more servicing operations upon the print heads 44. Upon completion of the servicing operations, controller 28 generates control signals directing the service mechanism to be withdrawn. Thereafter, controller 28 generates control signal directing actuator 35 to once again lower print module 22 (including printhead supports 41 and cartridges 43) toward media support 37 (as represented by directional arrow B in FIG. 6) into a printing position shown in FIG. 7 to place the cartridges 43 in close proximity to media web 30 for printing.

In one aspect, the arcuate shape of first arcuate frame 50 of media support and second arcuate frame 59 of print module 22 permits servicing printheads 44 (FIGS. 1-2) without lateral movement of cartridges 43, thereby substantially reducing misalignment issues that typically occur in conventional printing systems after servicing printheads. In addition, the arcuate shape of the frames 50 and 59 provide a compact design that minimizes the footprint of printing system 20.

Figure 8:
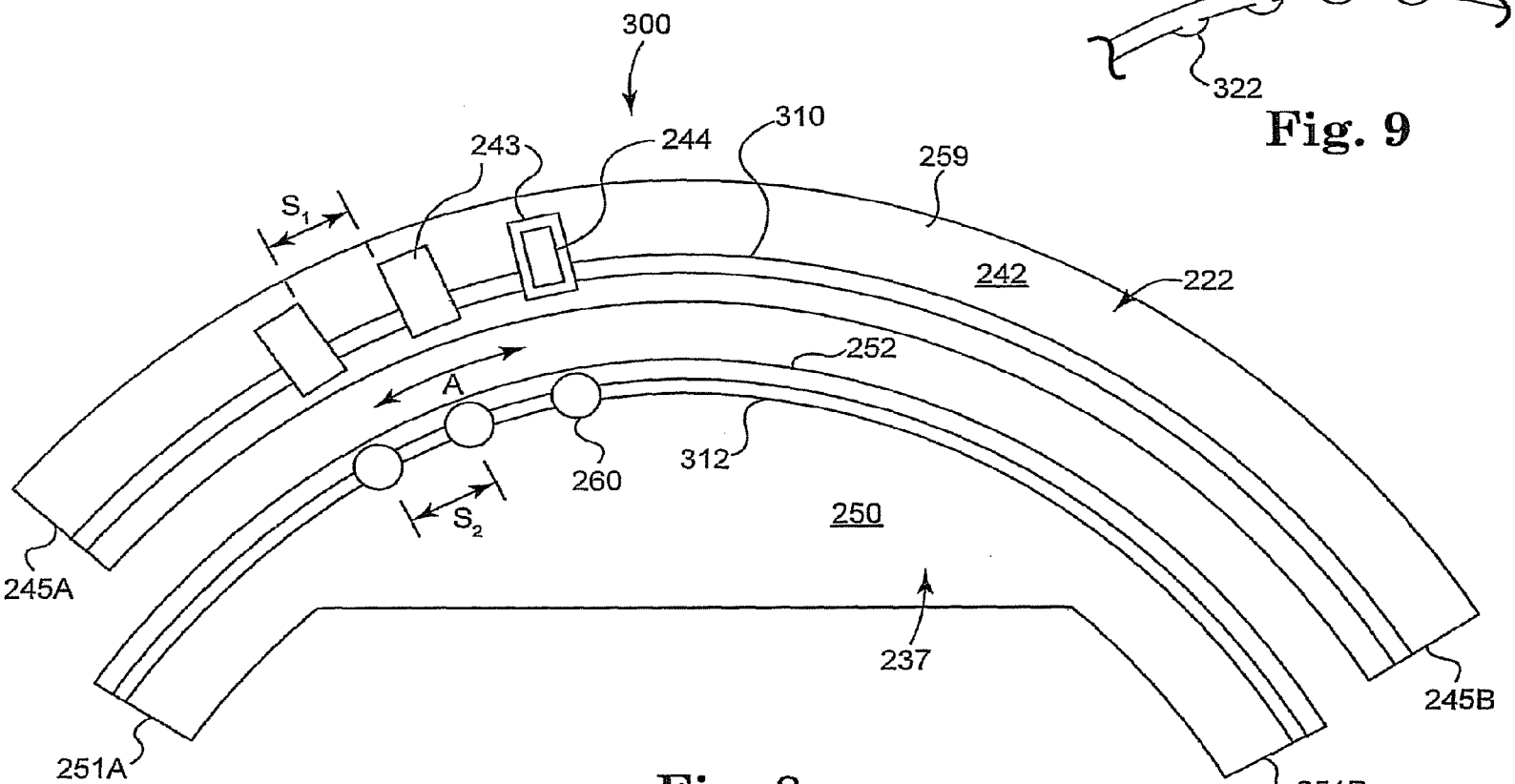
FIG. 8 is a front view of a printing system including a first arcuate frame and a second arcuate frame, each including a positioning slot, according to an embodiment of the present disclosure.

FIG. 8 is schematic illustration of a printing system 300, according to one embodiment of the present disclosure. In one embodiment, printing system 300 comprises substantially the same features and attributes as printing systems 20, 200, and 270 as previously described in association with FIGS. 1-7, with like references referring to like elements. As shown in FIG. 8, printing system 300 comprises a print module 222 comprising an arcuate frame 259 and a media support 237 comprising an arcuate frame 250. Arcuate frame 259 supports a series of print cartridges 243 (including printheads 244) in an arc configuration while arcuate frame 250 supports rollers 260 in an arc configuration. In one aspect, arcuate frame 259 of print module 222 comprises an arc-shaped slot 310 generally matching the arcuate shape of frame 259. The slot 310 is configured to enable selective positioning of printhead cartridges 243 along the arcuate frame 259. In addition, arcuate frame 250 of media support 237 comprises an arc-shaped slot 312 generally matching the arcuate shape of frame 250. The slot 312 is configured to enable selective positioning of rollers 260 along the arcuate frame 250. Moreover, the respective slots 310, 312 are configured to be cooperable with a suitable fastening mechanism to position the cartridges 243 and rollers 260, respectively, at discrete positions along the respective arcuate frames 259 and 250. In one aspect, slot 310 and 312 enable slidable positioning of the cartridges 243 apart from each other along slot 310 by a distance (S1) substantially the same as a distance (S2) separating the spaced apart rollers 260, which are positioned by slidable movement along slot 312. This arrangement enables selectively positioning individual printing units 100 (including a row of cartridges 243 and one roller 260) along the web flow path 36 (FIGS. 1-2).

In one embodiment, the cartridges 243 are further supported by printhead supports in a manner substantially similar to the arrangement of printhead supports 41, 241 described in association with FIGS. 1-7. In this arrangement, the printhead supports are slidably movably along the slot 310 to selectively position the printhead support and thereby selectively position the rows of cartridges 243 supported by the respective printhead support.

Figure 9:
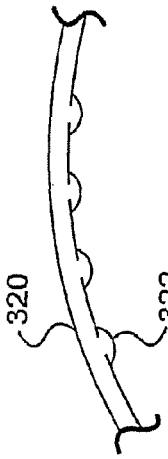
FIG. 9 is a partial front view of a positioning slot with detents, according to an embodiment of the present disclosure.

In addition, in another embodiment, slot 310 or 312 includes detents or other recesses that are spaced apart from each other to create selectable positions along the arcuate frames 250 or 259. Accordingly, FIG. 9 illustrates one non-limiting example of a slot 320 (corresponding to slot 310 and/or 312) including a series of detents 322 configured to receive, and releasably secure, an end portion of a printhead support to thereby position the printhead support 41 (or roller 60) at discrete positions along the respective arcuate frames 50 and 59 (or 250 and 259 in FIGS. 6-7).

Embodiments of the present disclosure include arcuate frame structures to support printheads of a print module and rollers of a media support. These embodiments provide for convenient reconfiguration of individual printing units along a web press while also increasing printing quality via controlling a position and tension of a media web in an area local to each printhead of the printing module. In addition, the arcuate frame structures provide for movement of a print module between a servicing position and a printing position while substantially preserving alignment of the printheads of the print module.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printer comprising:

an array of rollers arranged in a first arc configuration to rollingly support a media web in a first orientation;

an array of printing elements arranged in a second arc configuration along the first orientation and movable relative to the array of rollers to selectively modify a vertical space therebetween, wherein each respective printing element is aligned directly above one of the respective rollers to define a printing unit; and a positioning structure configured to releasably secure each printing unit at one position of a plurality of positions along the respective first and second arc configurations, wherein the individual printing units are separated into a series of successive zones including at least one printing zone and at least one rest zone, wherein the at least one printing zone includes at least one printing unit at one of the positions along the first and second arc configurations, and wherein the rest zone omits at least one printing unit at one of the positions along the first and second arc configurations.

2. The printer of claim 1 wherein each printing element comprises:

a printbar extending in a second orientation generally perpendicular to the first orientation; and a row of printhead cartridges supported by the printbar.

3. The printer of claim 1 wherein the array of rollers is supported by a first frame that comprises a pair of arcuate plates spaced apart from each other in a second orientation generally perpendicular to the first orientation and each respective roller extends between, and is supported by, the respective arcuate plates of the first frame, and wherein the array of printing elements is supported by a second frame that comprises a pair of arcuate plates spaced apart from each other in the second orientation and each respective printing element extends between, and is supported by, the respective arcuate plates of the second frame.

4. The printer of claim 3 wherein at least one of the first frame or the second frame is in a fixed position and the other one of the respective first frame and the second frame is movable relative thereto.

5. The printer of claim 3 wherein the positioning structure comprises:

a first series of spaced apart holes formed in a top portion of each of the respective arcuate plates of the first frame; and a second series of spaced apart holes formed in a bottom portion of each of the respective arcuate plates of the second frame, wherein the first series of holes is configured to releasably secure the rollers at one of the respective positions along the first arc configuration and wherein the second series of holes is configured to releasably secure the printing elements at one of the respective positions along the second arc configuration.

6. The printer of claim 3 wherein the positioning structure comprises:

a first slot defined within, and extending in an arc along, each respective plate of the first frame, the first slot configured to mount each roller to be slidably movable within the first slot to one of the positions along the first arc configuration; and a second slot defined within, and extending in an arc along, each respective plate of the second frame, the second slot configured to mount each printing element to be slidably movable within the second slot to one of the positions along the second arc configuration, wherein, after each positioning of the rollers within the first slot and each positioning of the printing elements in the second slot, a first distance between adjacent rollers is substantially the same as a second distance between adjacent printing elements.

7. The printer of claim 3 wherein the arcuate plates of the second frame are spaced apart by a first distance substantially greater than a second distance between the spaced apart plates of the first frame such that the first frame is at least partially nestable within the spaced apart plates of the second frame along the second orientation.

8. The printer of claim 1 wherein the rest zone is further defined by a spacer roller removably inserted at one of the respective positions within the rest zone and configured to rollingly support the media web, wherein the rest zone defines that the printer includes at least one position along the first arc configuration on opposite sides of the spacer roller that omit the respective printing units.

9. The printer of claim 1 wherein the respective rollers are spaced apart by a minimum distance sufficient to cause the media web to wrap about a partial circumference of each respective roller, and wherein the partial circumference of each respective roller in contact with the media web defines an active printing area corresponding to more than two rows of nozzles of a printhead of the printing element.

10. The printer of claim 9 wherein the partial circumference of each respective roller in contact with the media web defines an arc length of at least about 4 to 5 degrees of a 360 degree circumference of the roller.

11. The printer of claim 9, wherein the active printing area corresponds to at least eight rows of nozzles of the printhead of the printing element.

12. A printer comprising:

an array of rollers arranged in a first arc configuration to rollingly support a media web in a first orientation;

an array of printing elements arranged in a second arc configuration along the first orientation and movable relative to the array of rollers to selectively modify a vertical space therebetween, wherein each respective printing element is aligned directly above one of the respective rollers to define a printing unit; and a positioning structure configured to releasably secure each printing unit at one position of a plurality of positions along the respective first and second arc configurations, wherein at least some of the individual printing units are grouped into at least one print zone extending along at least a portion of the respective first and second arc configurations, and wherein each roller within the at least one print zone has a one-to-one correspondence with a respective one of the printing elements within the at least one print zone, wherein the printing units are repositionable along the first and second arc configurations to define a plurality of print zones, including the at least one print zone, and to define at least one rest zone in which printing units are omitted with the rest zone interposed between adjacent printing zones, wherein the number of printing units can vary within each print zone upon instances of repositioning the printing units along the first and second arc configurations, and wherein, upon completion of each instance of repositioning, the one-to-one correspondence is maintained with each roller having a respective one of the printing elements aligned above the respective roller.

13. A printer comprising:

an array of rollers arranged in a first arc configuration to rollingly support a media web in a first orientation, wherein the array of rollers is supported by a first frame that comprises a pair of arcuate plates spaced apart from each other in a second orientation generally perpendicular to the first orientation and each respective roller extends between, and is supported by, the respective arcuate plates of the first frame;

an array of printing elements arranged in a second arc configuration along the first orientation and movable relative to the array of rollers to selectively modify a vertical space therebetween, wherein each respective printing element is aligned directly above one of the respective rollers to define a printing unit; and a positioning structure configured to releasably secure each printing unit at one position of a plurality of positions along the respective first and second arc configurations, wherein at least some of the individual printing units are grouped into at least one print zone extending along at least a portion of the respective first and second arc configurations, and wherein each roller within the at least one print zone has a one-to-one correspondence with a respective one of the printing elements within the at least one print zone, wherein the array of printing elements is supported by a second frame that comprises a pair of arcuate plates spaced apart from each other in the second orientation and each respective printing element extends between, and is supported by, the respective arcuate plates of the second frame, and wherein the positioning structure comprises:

a first slot defined within, and extending in an arc along, each respective plate of the first frame, the first slot configured to mount each roller to be slidably movable within the first slot to one of the positions along the first arc configuration; and a second slot defined within, and extending in an arc along, each respective plate of the second frame, the second slot configured to mount each printing element to be slidably movable within the second slot to one of the positions along the second arc configuration, and wherein, after each positioning of the rollers within the first slot and each positioning of the printing elements in the second slot, a first distance between adjacent rollers is substantially the same as a second distance between adjacent printing elements, wherein each of the first slot and the second slot include a series of securing elements to enable releasably securing the rollers within the first slot and to enable releasably securing the printing elements within the second slot at discrete positions along the frame to enable repositioning the respective printing units along the frame into one of a plurality of different configurations that define the at least one print zone, and wherein each different configuration includes consecutively positioned printing units and at least some of the different configurations includes a different number of printing units.

14. The printer of claim 12 wherein each printing element comprises:

a printbar extending in a second orientation generally perpendicular to the first orientation; and a row of printhead cartridges supported by the printbar.

15. The printer of claim 12, wherein the array of rollers is supported by a first frame that comprises a pair of arcuate plates spaced apart from each other in a second orientation generally perpendicular to the first orientation and each respective roller extends between, and is supported by, the respective arcuate plates of the first frame, and wherein the array of printing elements is supported by a second frame that comprises a pair of arcuate plates spaced apart from each other in the second orientation and each respective printing element extends between, and is supported by, the respective arcuate plates of the second frame.

16. The printer of claim 15 wherein at least one of the first frame or the second frame is in a fixed position and the other one of the respective first frame and the second frame is movable relative thereto.

17. The printer of claim 12 wherein the at least one rest zone is further defined by a spacer roller removably inserted at one of the respective positions within the at least one rest zone and with the spacer roller configured to rollingly support the media web, wherein the at least one rest zone defines that the printer includes at least one position along the first arc configuration on opposite sides of the spacer roller that omit the respective printing units.

* * * * *